US005255843A

United States Patent [19]

Deakyne

[11] Patent Number: 5,255,843

[45] Date of Patent: Oct. 26, 1993

[54] MAILBOX ALERT APPARATUS

[76] Inventor: Robert S. Deakyne, 754 Madison Ave., Elizabeth, N.J. 07201

[21] Appl. No.: 950,189

[22] Filed: Sep. 24, 1992

[51] Int. Cl.[5] ..... B65D 91/00

[52] U.S. Cl. ..... 232/35; 232/36; 200/573; 200/330

[58] Field of Search ..... 232/17, 34, 35, 36, 232/37; 200/573, 574, 330, 329, 336, 337; 340/569

[56] References Cited

U.S. PATENT DOCUMENTS

| | | | |
|---|---|---|---|
| 918,530 | 4/1909 | Gingrich | 232/35 |
| 1,442,578 | 1/1932 | Landrum | 232/36 |
| 2,088,806 | 8/1937 | Ottmann | 232/34 |
| 2,809,780 | 10/1957 | Doetsch | 232/32 |
| 3,318,516 | 5/1967 | Scheerer | 232/35 |
| 3,572,581 | 3/1971 | McLeod | 232/35 |
| 3,621,172 | 11/1971 | Clark | 200/574 |
| 3,968,928 | 7/1976 | Caldwell | 232/35 |
| 4,860,949 | 8/1989 | Moore | 232/35 |
| 4,913,342 | 4/1990 | Fluck | 232/35 |

FOREIGN PATENT DOCUMENTS

| | | | |
|---|---|---|---|
| 228891 | 9/1943 | Switzerland | 232/34 |

*Primary Examiner*—Peter M. Cuomo
*Assistant Examiner*—Flemming Saether
*Attorney, Agent, or Firm*—Leon Gilden

[57] ABSTRACT

An alarm housing mounted to an exterior side wall surface of an associated rural or house mounted mailbox includes a switch arm having a roller cylinder mounted at a distal end thereof in engagement with the door portion of a rural mailbox, whereupon pivoting of the rural mailbox door to an opened orientation displaces the roller effecting closure of a switch within the alarm housing to activate visual and audible alarm structure.

4 Claims, 4 Drawing Sheets

MAILBOX ALERT APPARATUS

BACKGROUND OF THE INVENTION

1. Field of the Invention

The field of invention relates to mailbox alarm structure, and more particularly pertains to a new and improved mailbox alert apparatus wherein the same is arranged to provide for visual and optional audible indication of opening of a house mounted or rural mailbox door indicating mail delivery therewithin.

2. Description of the Prior Art

Alarm structure relative to the signalling of mail delivery has been utilized in the prior art and indicated in U.S. Pat. No. 4,986,467 to Bibbee wherein a signal flag is arranged to project to an alert orientation upon opening of a mailbox door.

Further, various mailbox signal structure is indicated in the U.S. Pat. Nos. 4,868,543; 4,877,180; 4,875,621; and 4,964,565.

The instant invention attempts to overcome deficiencies of the prior art by providing for a structure arranged for ease of retrofit in cooperative association with a mailbox door structure to indicate mail delivery and in this respect, the present invention substantially fulfills this need.

SUMMARY OF THE INVENTION

In view of the foregoing disadvantages inherent in the known types of mailbox alert apparatus now present in the prior art, the present invention provides a mailbox alert apparatus wherein the same is directed to the alerting of mailbox mail delivery upon opening of an associated mailbox door. As such, the general purpose of the present invention, which will be described subsequently in greater detail, is to provide a new and improved mailbox alert apparatus which has all the advantages of the prior art mailbox alert apparatus and none of the disadvantages.

To attain this, the present invention provides an alarm housing mounted to an exterior side wall surface of an associated rural mailbox, including a switch arm having a roller cylinder mounted at a distal end thereof in engagement with the door portion of a rural mailbox, whereupon pivoting of the rural mailbox door to an opened orientation displaces the roller effecting closure of a switch within the alarm housing to activate visual and audible alarm structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mailbox alert apparatus which has all the advantages of the prior art mailbox alert apparatus and none of the disadvantages.

It is another object of the present invention to provide a new and improved mailbox alert apparatus which may be easily and efficiently manufactured and marketed.

It is a further object of the present invention to provide a new and improved mailbox alert apparatus which is of a durable and reliable construction.

An even further object of the present invention is to provide a new and improved mailbox alert apparatus which is susceptible of a low cost of manufacture with regard to both materials and labor, and which accordingly is then susceptible of low prices of sale to the consuming public, thereby making such mailbox alert apparatus economically available to the buying public.

Still yet another object of the present invention is to provide a new and improved mailbox alert apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
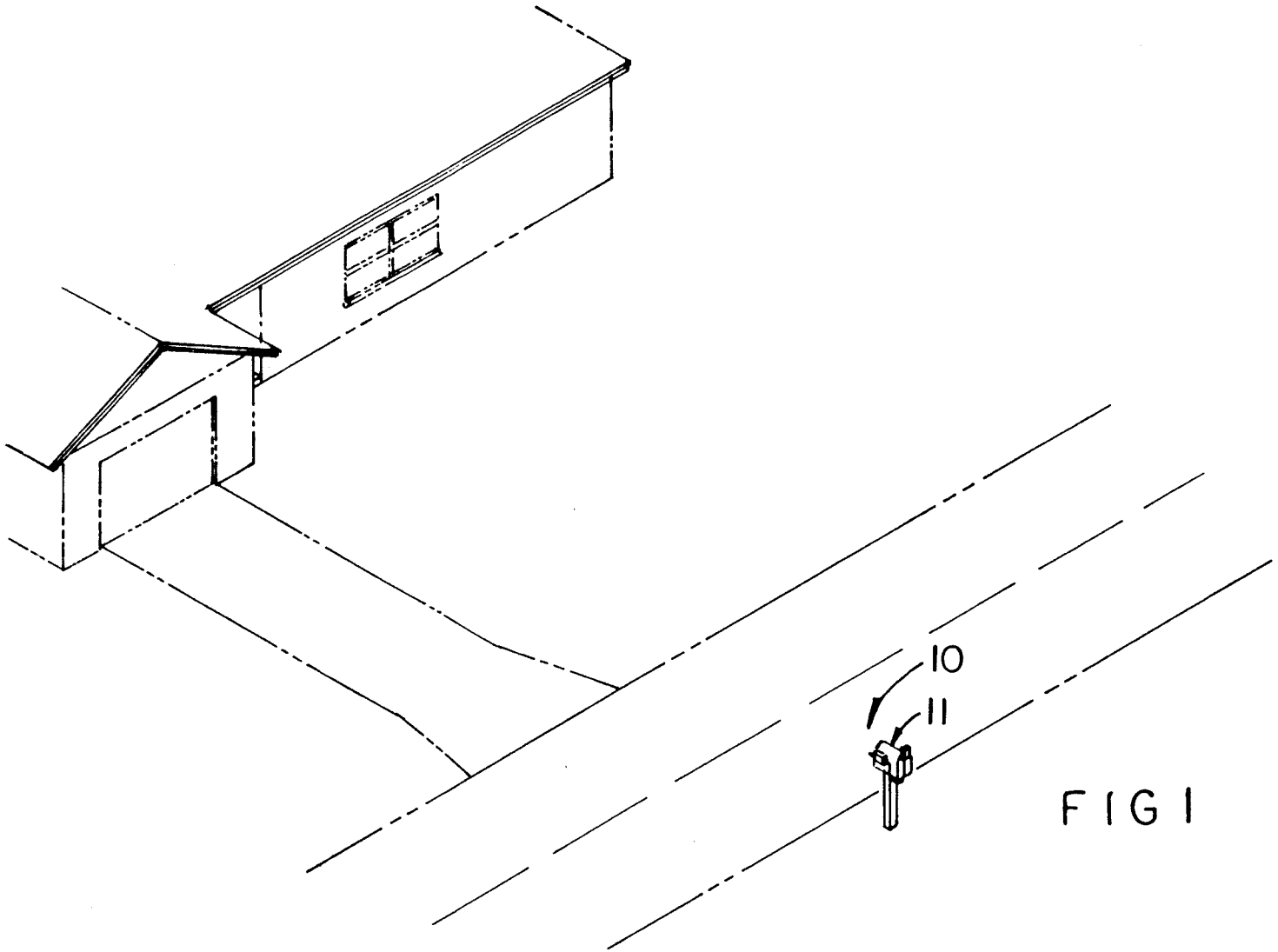
FIG. 1 is an isometric illustration of the invention relative to a mailbox and dwelling structure.

With reference now to the drawings, and in particular to FIGS. 1 to 6 thereof, a new and improved mailbox alert apparatus embodying the principles and concepts of the present invention and generally designated by the reference numeral 10 will be described.

More specifically, the mailbox alert apparatus 10 of the instant invention essentially comprises a combination with a rural mailbox 11 having mailbox side walls 12 mounted to a mailbox floor 13. A mailbox door plate 14 is pivotally mounted relative to the floor and to an entrance opening of the mailbox 11 at a forward end thereof between the side walls 12 and the floor 13. An alarm housing 15 is mounted to one of the side walls 12 utilizing adhesives, mechanical fasteners, or their equivalence. An alert housing 16 is mounted to the mailbox 11 in any convenient orientation but desirably to a rear end wall of the mailbox spaced from the entrance opening.

The alarm housing 15 includes an alarm housing mounting wall 17 mounted in continuous communication to said one of the side walls 12, with an alarm housing cap 18 mounted overlying coextensive with the mounting wall 17. The cap includes a cap top wall 19 spaced from and parallel relative to the mounting wall 17, a front wall 20, and a front wall opening 21 directed through the front wall 20 in adjacency to the mailbox entrance opening. Cap side walls 22, as well as the cap front wall 20 and a cap rear wall, are securable to the mounting wall 17. Battery members 23 are mounted to the cap mounting wall 17, each received within a battery support cup 24 to effect electrical communication between battery members 23 and a switch member 25 positioned in adjacency to the battery members 23 secured to the mounting wall 17.

The switch member 25 includes a switch member contact plate 26, whereupon placement of the contact plate 26 that is reciprocatably mounted relative to the switch member 25 effects closure of the switch member 25 to effect electrical communication between the batteries 23 through the switch member 25 relative to the alert housing 16, to be discussed in more detail below.

Figure 2:
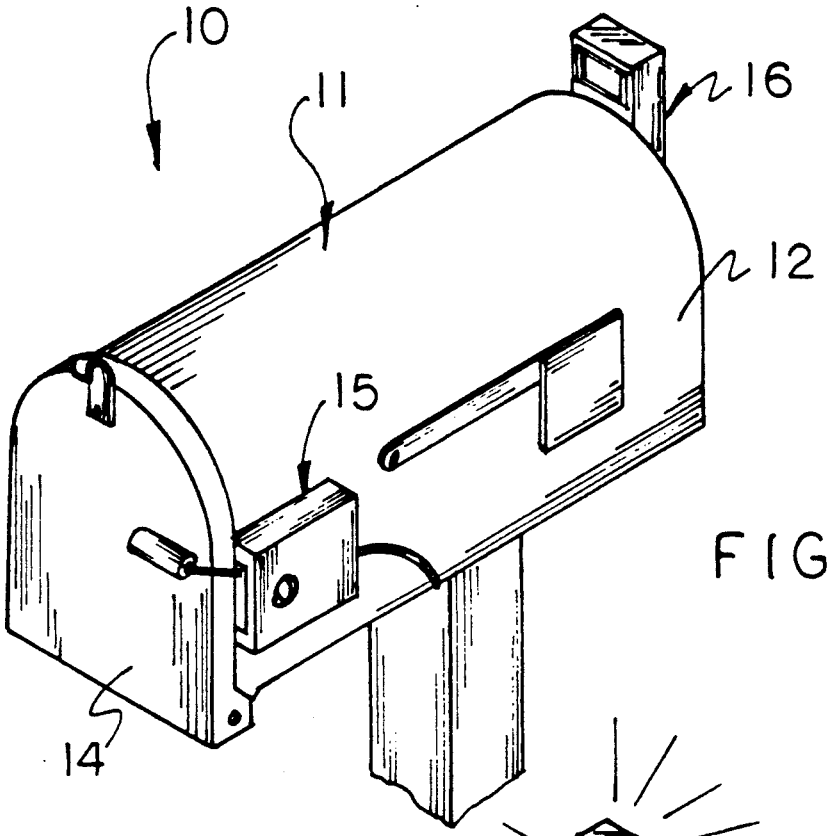
FIG. 2 is an isometric illustration of the invention in a first position relative to a mailbox.
Figure 3:
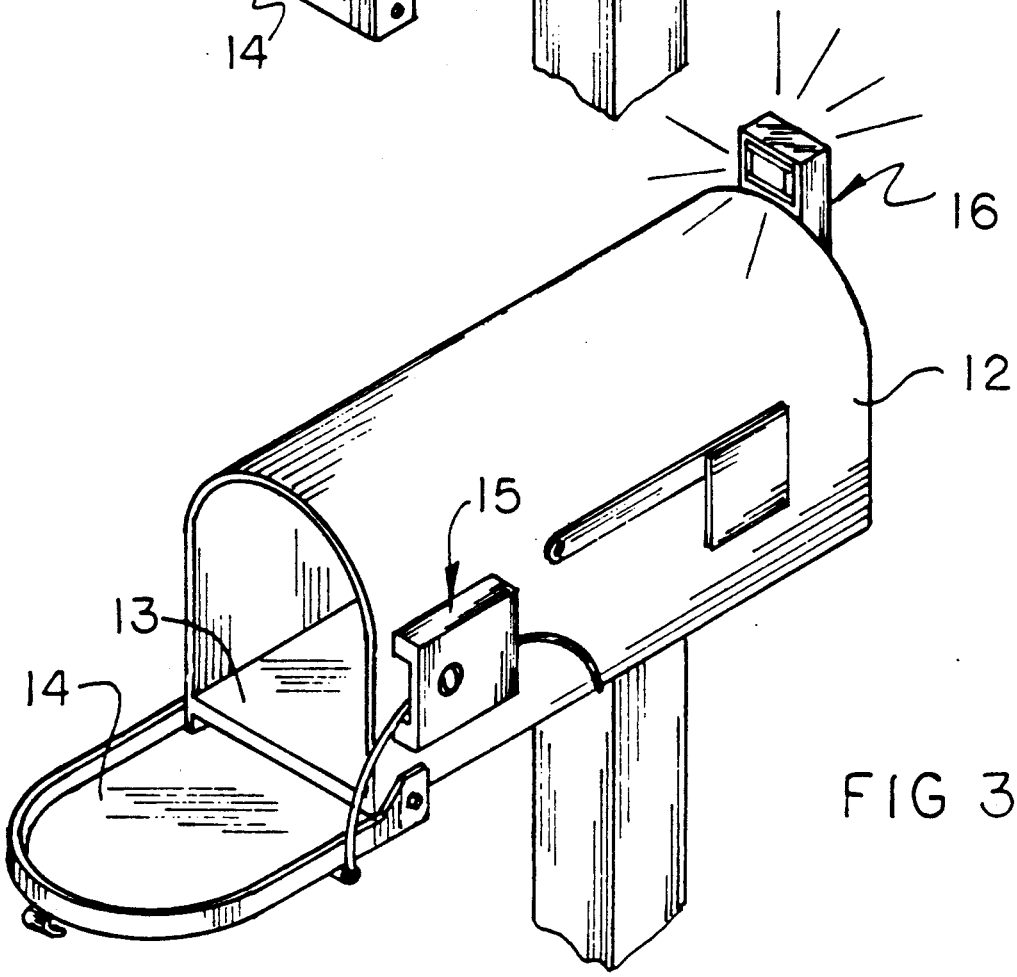
FIG. 3 is an isometric illustration of the invention in a second position relative to an associated rural mailbox.
Figure 4:
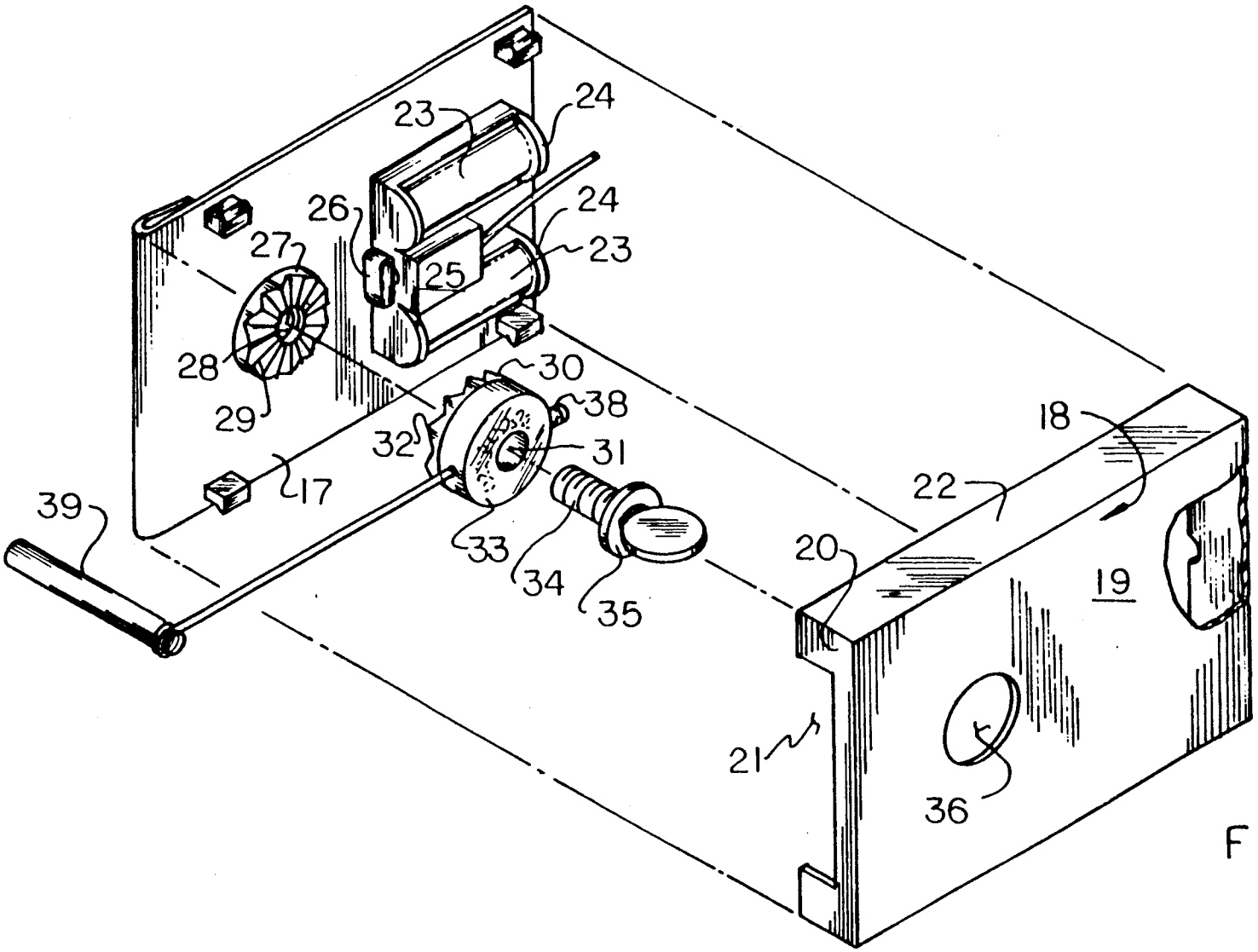
FIG. 4 is an isometric exploded view of the control housing structure of the invention.

A support boss 27 is fixedly mounted to the mounting wall 17 in adjacency to the switch member 25 and the contact plate 26. The support boss 27 includes a support boss central bore 28 coaxially directed through the support boss 27, with the support boss 27 including an array of support boss radial splines 29 directed from the support boss central bore 28 to an outer periphery of the support boss 27. A mounting boss 30 is arranged for positioning upon the support boss 27 in a coaxially aligned relationship, wherein the mounting boss 30 includes a mounting boss bore 31 that is arranged for coaxial alignment with the support boss central bore 28. The mounting boss 30 includes an annular array of mounting boss radial splines 32 arranged for selective radial and rotative engagement with the support boss radial splines 29 to permit selective radial positioning of the support boss relative to the mounting boss. A bearing member 33 is mounted for radial displacement upon the mounting boss 30 in coaxial alignment with the mounting boss 30 and the support boss 27. The bearing member 33 is arranged to receive a fastener rod 34 through the bearing member 33 and the mounting boss bore 31 and the support boss central bore 28. The fastener rod 34 includes a fastener rod head 35 for selective frictional tension and engagement of the bearing member 33 and interengagement with the support boss and mounting boss. The cap member top wall 19 includes a top wall bore 36 that is arranged for coaxial alignment relative to the fastener rod 34 to receive a handle member of the fastener rod 34 that is fixedly mounted to the fastener rod head 35, wherein the handle member projects through the top wall bore 36 for ease of manual manipulation to provide for desired frictional placement of the support boss, the mounting boss, and the bearing member together. A switch arm 37 and a switch lug 38 are longitudinally aligned and project exteriorly of the bearing member 33 on diametrically opposed sides of the bearing member 33, with the switch lug 38 positioned in operative communication with the contact plate 26. A switch arm roller 39 is orthogonally mounted to an outer distal end of the switch arm 37 in communication with the door plate 14. Opening of the door plate 14 to a second position, as indicated in FIG. 3, from a first position overlying the entrance opening of the mailbox effects radial displacement of the switch arm 37 and the switch lug 38 upon selective rotation of the bearing member 33. In this manner, closure of the switch member 25 is effected to direct electrical energy from the batteries 23 to the alert housing 16. It should be noted that the bearing member 33 may be arranged for biased mounting to the mounting boss 30 to maintain the first position, in a manner as indicated in FIG. 2.

Figure 5:
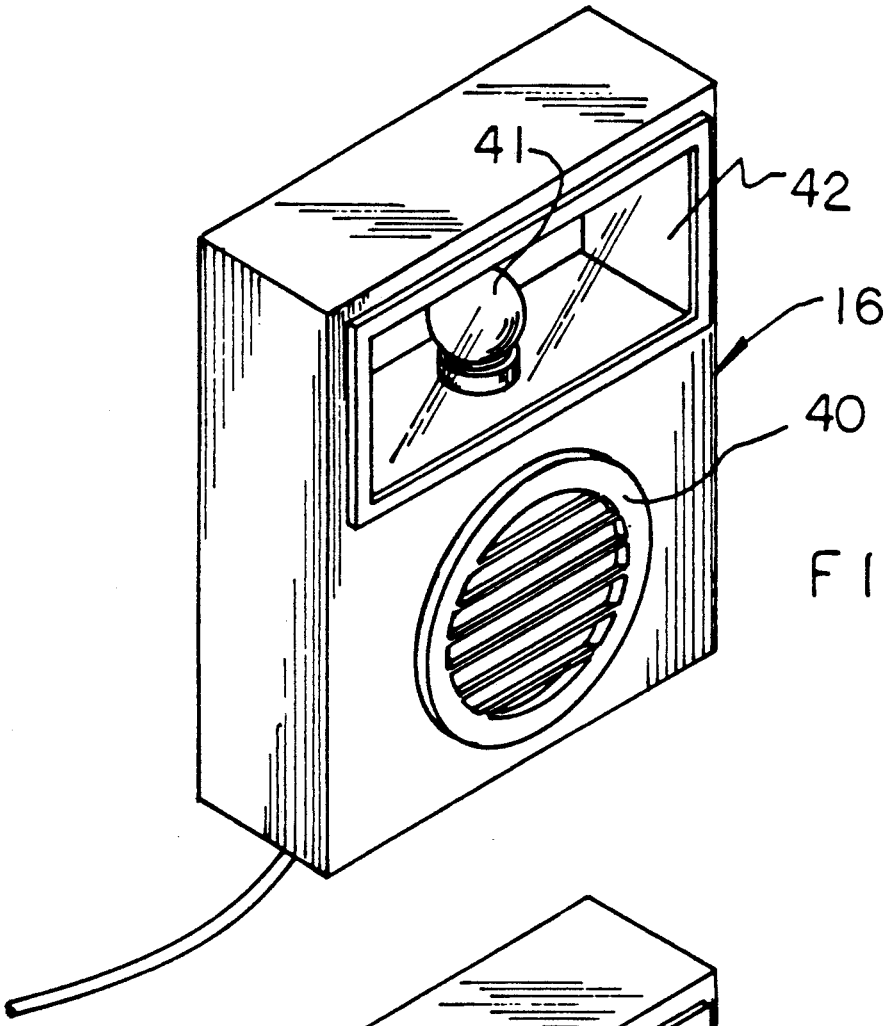
FIG. 5 is an isometric frontal view of the alert housing of the invention.
Figure 6:
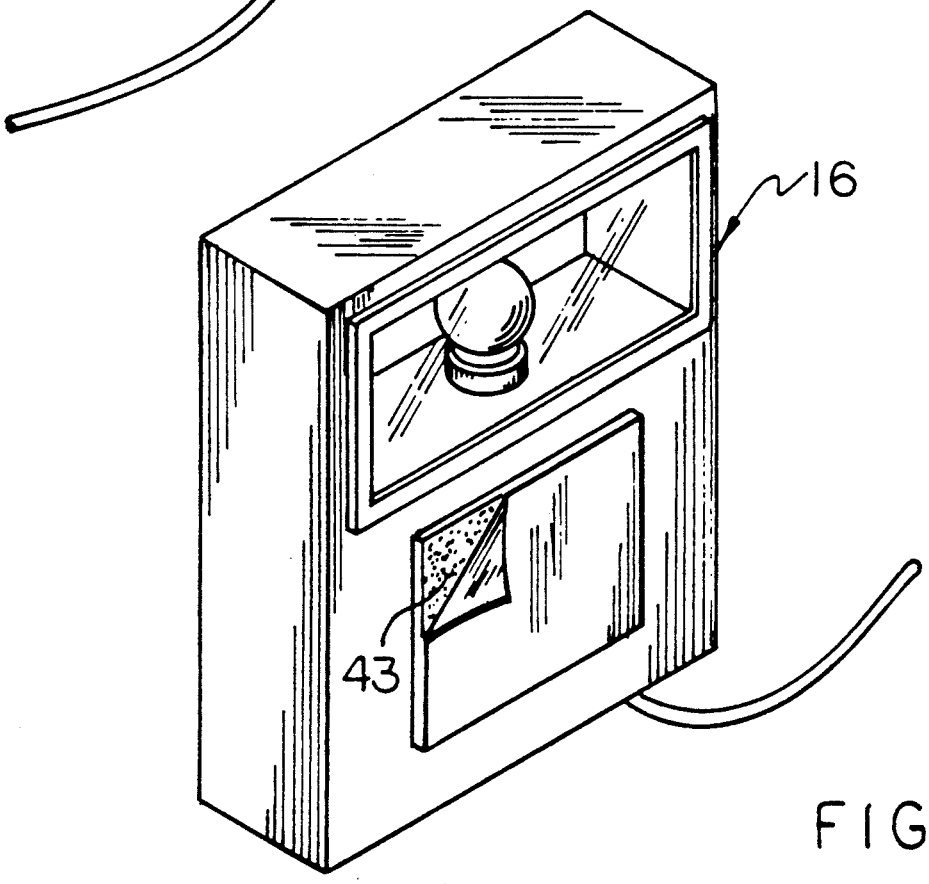
FIG. 6 is an isometric rear view of the alert housing of the invention.

The alert housing 16, as indicated in the FIGS. 5 and 6, includes an audible alarm speaker directed through the front wall of the alert housing, with an adhesive pad 43 mounted to a rear wall of the alert housing for securement to the mailbox 11. A visual illumination member 41 is also provided positioned between spaced lenses 42 within the alert housing to provide for actuation of the illumination member 41. It is understood that either or both the use of an audible alarm and visual alarm may be employed by the invention. Simplicity of circuitry utilizing conventional direct current to orient the illumination member 41 and associated audible alarm in series relative to the switch member 25 is provided and understood by one of ordinary skill in the art as conventional in electrical circuitry to be employed by the invention. As noted above, a spring member 44 may be employed, having one end secured to the bearing member 33 and a further end mounted to the mounting boss 30 to maintain orientation of the switch arm 37 and the switch lug 38 as desired in a predetermined orientation relative to the contact plate 26.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mailbox alert apparatus, comprising in combination, a rural mailbox, with the rural mailbox having mailbox spaced side walls and a mailbox floor, a mailbox entrance opening is directed into the mailbox at a first end of the mailbox between the side walls and the floor, and a door plate is pivotally mounted to the mailbox floor in adjacency to the entrance opening, and an alarm housing, the alarm housing mounted to one of the side walls, and an alert housing mounted to the mailbox, with the alarm housing including an alarm housing mounting wall in contiguous communication with the side wall, and the alarm housing including an alarm housing cap, with the alarm housing cap having a cap top wall, a cap front wall, cap side walls, and a cap rear wall, with the cap front wall having a cap front wall opening, with the cap front wall opening positioned in adjacency to the mailbox entrance opening and the door plate, and at least one battery member mounted to the alarm housing mounting wall, and a switch member in electrical communication with the battery member, and a contact plate reciprocatably mounted relative to the switch member, and switch means in operative communication with the contact plate and the door plate for effecting closure of the switch member upon opening of the door plate to effect electrical communication between the battery and the alert housing, and the switch means includes a support boss, the support boss integrally mounted to the alarm housing mounting wall, with the support boss having a support boss internally threaded central bore, and support boss radial splines directed from the central bore to an outer periphery of the support boss, and a mounting boss, wherein the mounting boss includes a mounting boss bore coaxially aligned with the central bore, and an annular array of mounting boss radial splines cooperative with the support boss radial splines to effect rotative positioning of the mounting boss relative to the support boss, with contiguous communication of the mounting boss radial splines with the support boss radial splines, and a bearing member mounted to the mounting boss, with the bearing member coaxially aligned with the mounting boss and the support boss, and an externally threaded fastener directed through the mounting boss bore and threadedly received within the support boss central bore to secure in a predetermined angular orientation the bearing member relative to the support boss, and a switch arm mounted to the bearing member, with the switch arm projecting exteriorly of the bearing member, with the cap front wall having a cap front wall opening and the switch member directed through the cap front wall opening, and the switch member having a switch arm roller, the switch arm roller in contiguous communication with the door plate, and a switch lug mounted to the bearing member longitudinally aligned with the switch arm, whereupon the switch arm roller is in contiguous communication with the door plate, whereupon pivoting of the door plate effects pivoting of the switch arm and the switch lug, and the switch lug arranged in adjacency to the contact plate to effect communication with the contact plate and closure of the switch member.

2. An apparatus as set forth in claim 1 including a spring member, the spring member having a first end mounted to the bearing member, and second end secured to the mounting boss to maintain a predetermined orientation of the bearing member relative to the mounting boss.

3. An apparatus as set forth in claim 2 wherein the alert housing includes a visual alarm having an illumination member, and the alert housing having an alert housing rear wall, the alert housing rear wall having an adhesive pad for adhesive securement of the alert housing relative to the mailbox.

4. An apparatus as set forth in claim 3 wherein the alert housing includes an audible alarm in operative communication with the battery member and the switch member and the visual alarm to effect simultaneous actuation of the visual alarm and the audible alarm upon pivoting of the door plate in a spaced relationship relative to the mailbox entrance opening.

* * * * *